US006555793B2

(12) United States Patent
Griffiths et al.

(10) Patent No.: US 6,555,793 B2
(45) Date of Patent: Apr. 29, 2003

(54) ADVANCED RADIANT ELECTRIC HEATER

(75) Inventors: Simon P. Griffiths, Columbus, MS (US); Herbert G. Ray, Columbus, MS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/189,564

(22) Filed: Nov. 11, 1998

(65) Prior Publication Data

US 2001/0003335 A1 Jun. 14, 2001

(51) Int. Cl.[7] ..... H05B 3/68

(52) U.S. Cl. ..... 219/446.1; 219/448.11; 219/448.12; 219/494

(58) Field of Search ..... 219/443, 445, 219/446, 448.11, 448.12, 464, 519, 627, 538, 540, 494, 448.17; 428/367

(56) References Cited

U.S. PATENT DOCUMENTS 3,068,340 A * 12/1962 Bremer et al. ..... 219/445
3,346,721 A 10/1967 Bassett, Jr.
3,612,827 A 10/1971 Dills
3,646,321 A 2/1972 Siegla ..... 219/464
3,686,477 A 8/1972 Dills et al.
3,733,462 A 5/1973 Bouchard et al.
3,742,179 A * 6/1973 Harden, Jr. ..... 219/627
3,833,793 A 9/1974 McWilliams et al.
4,032,750 A * 6/1977 Hurko ..... 219/464
4,237,368 A * 12/1980 Welch ..... 219/448.12
4,302,508 A * 11/1981 Hierholzer, Jr. et al. .... 428/367
4,414,465 A 11/1983 Newton et al.
4,816,647 A * 3/1989 Payne ..... 219/448.12
5,128,516 A * 7/1992 Plasko et al. ..... 219/494
5,256,860 A * 10/1993 Newman et al. ..... 219/448.12
5,397,873 A * 3/1995 Stoops et al. ..... 219/448.12
5,430,427 A * 7/1995 Newman et al. ..... 219/448.17
5,658,480 A * 8/1997 Tennant et al. ..... 219/519
5,721,419 A 2/1998 Wauer et al. ..... 219/497
5,780,817 A 7/1998 Eckman et al.
5,856,654 A * 1/1999 Frasnetti et al. ..... 219/448.12
5,877,475 A * 3/1999 Hecht et al. ..... 219/448.11

* cited by examiner

*Primary Examiner*—Teresa Walberg
*Assistant Examiner*—Fadi H. Dahbour
(74) *Attorney, Agent, or Firm*—Howrey Simon Arnold & White, LLP

(57) ABSTRACT

An improved heating unit (10) used in a cooktop (12). Operation of the heating unit is by a controller (16). An electric current is applied to a composition heating element (20). The heating element is supported on a cake (24) of insulation material installed in a pan (22) located beneath a glasstop (14) of the cooktop. A thermal sensor (28) senses the temperature of the heating element and supplies an indication of the heating element temperature to the controller which changes the amount of current supplied to the heating element as a function of the sensed temperature.

19 Claims, 4 Drawing Sheets

ADVANCED RADIANT ELECTRIC HEATER

BACKGROUND OF THE INVENTION

This invention relates to radiant electric heaters such as used in cooktops on stoves, and more particularly, to an advanced radiant electric heater which is lower in cost and has a potentially longer service life than conventional radiant electric heaters.

Radiant electric heating units, as is well-known in the art, comprise an electrical heating element such as a coil heating element, or a ribbon heating element. In conventional heating units, the ends of the heating element connect through a thermal switch to an electrical circuit by which current is supplied to the heating element. The unit is installed beneath a heating surface upon which utensils are placed. Heat generated by the heating element is transferred to the heating surface by radiation, and from the heating surface to the utensil by conduction. The thermal switch is responsive to the heating unit temperature exceeding a preset temperature to open the circuit path between a power source and the heating element to cut off current flow to the heating element. When the temperature falls back below the preset temperature, the switch reconnects the circuit path to restore the current flow to the heating element.

There are a number of problems with existing heating units. One of these is the thermal switch. The thermal switch assembly is expensive, representing 20–30% of the total cost of a heating unit. The switch assembly is a primary source of heating unit failure. It is simply too expensive to replace a failed switch. Rather, when the switch fails, the heating unit is discarded and a new heating unit substituted in its place. Elimination of the existing thermal switch would not only be a substantial cost savings, but would also improve the service life of a heating unit; provided, that proper temperature control of the heating unit is still maintained.

BRIEF SUMMARY OF THE INVENTION

Among the several objects of the present invention may be noted the provision of an improved radiant electric heating unit for use in stoves, cook tops, and the like;

- the provision of such a heating unit to eliminate a thermal switch normally used in such units but which is the most expensive item in the unit and one the major sources of heating unit failure;
- the provision of such a heating unit to employ a thermal sensing element which is a low cost, reliable element that supplies a temperature indication of the heating unit temperature to a controller or the like which controls supply of power to the heating unit to turn it on and off;
- the provision of such a heating unit in which the thermal sensing element which, in one embodiment, is located within the heat unit, either on-center or off-center, to sense heating unit temperature;
- the provision of such a heating unit in which the thermal sensing element, in another embodiment, extends inwardly into the heating unit from the side of the unit; and,
- the provision of such a heating unit for use in an advanced cooking unit in which the heating unit temperature is precisely controlled throughout a cooking cycle to better assist in the preparation of food.

In accordance with the invention, generally stated, an improved heating unit is used in a cooktop in which operation of the heating unit being effected by a controller. An electric current is supplied to a composition heating element to generate heat. The heating element is installed in a pan located beneath the cooktop. A thermal sensor senses the temperature of the heating element and supplies an indication of the heating element temperature to the controller which changes the amount of power supplied to the heating element as a function of the sensed temperature. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 8:
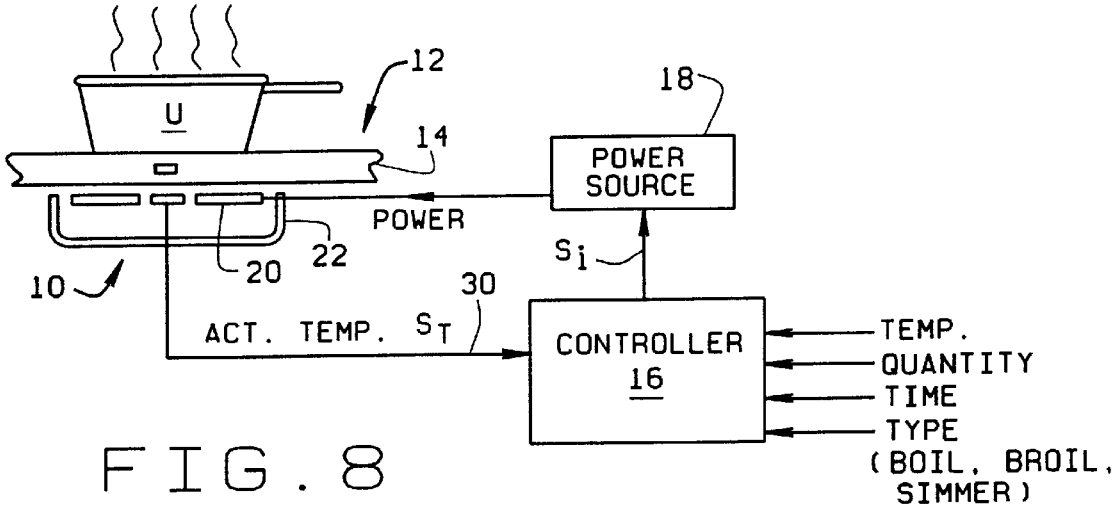
FIG. 8 illustrates operation of the heating unit in connection with a controller for controlling the cooking of food with a heating unit.

Referring to the drawings, a plurality (four) of heating units 10 of the present invention are installed in a cooktop 12 of conventional manufacture. Two of the heating units are of one wattage, and the other two units being of a different wattage. The cooktop, which forms part of the top surface of a range or the like, includes a glass/ceramic surface 14 beneath which the heating units are mounted. Someone desiring to cook food places the food in a utensil U (see FIG. 8) which is then set upon the top of the cooking surface over one of the heating units. The user then turns a knob or other temperature control device (not shown) to a setting indicating the temperature to be produced by the heating unit to cook the food.

It is now desirable to have better control over the cooking of food than has previously been possible. To this end, heating unit 10 of the present invention is usable with a controller 16 which controls the application of power to the heating unit by a power source 18. Operation of the controller is described in copending, coassigned U.S. patent application Ser. No. 09/095,919, which is incorporated herein by reference. One requirement of heating units is that they now be able to rapidly heat up to an operating temperature. This is evidenced by a heating element 20 of heating unit 10 reaching a visual response temperature within 3–5 seconds after application of power, by which time the heating element is glowing. Heretofore, rapid heating of element 20 has been achieved by applying a voltage, for example, 240 VAC across the heating element, this voltage being applied the entire time the heating element is on. While this achieves rapid heating, the tradeoff has been increased temperature stress on the heating element and a reduced service life. As described in the copending application, controller 16 controls application of power so that this high level is applied only for a short interval after which a lesser voltage is applied. Heating element 20, can be a coil type heating element, a ribbon heating element, an etched or a cut foil heating element, and is used in a conventional heating system in which only a single level of voltage is supplied to the heating element throughout a heating cycle; as well as the dual level voltage scheme described in the copending application.

Figure 1:
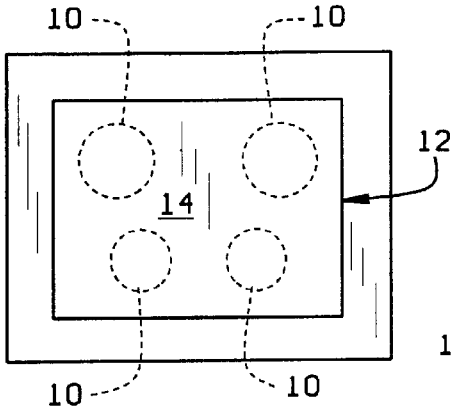
FIG. 1 is a top plan view of a cooktop in which a radiant heating unit of the present invention is installed.
Figure 2:
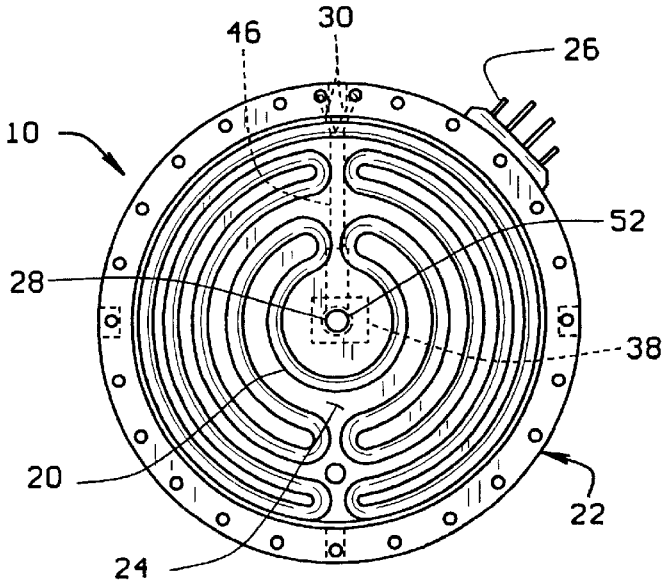
FIG. 2 is top plan view of a first embodiment of the heating unit.
Figure 3:
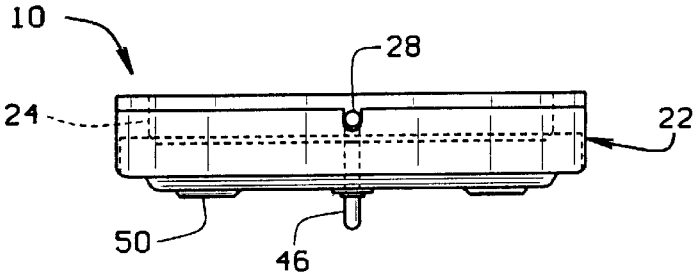
FIGS. 3 and 4 are respective side elevational views of the heating unit.
Figure 4:
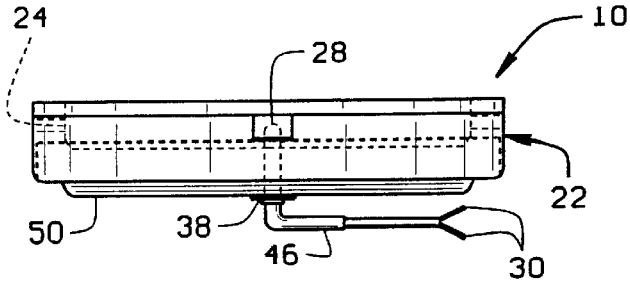

Referring to FIGS. 2–4, heating unit 10 includes a pan 22 which is a shallow pan in which a cake 24 of an insulation material is supported. Heating element 20 is carried on the insulation material. The heating element may be a composition heating element such as described in copending, coassigned U.S. patent application Ser. No. 08/908,755, the teachings of which are also incorporated herein by reference; or one of the other types of heating elements previously mentioned. As shown in FIG. 2, the heating element has a serpentine or sinuous pattern when installed on the insulation material. It will be understood that the pattern shown in FIG. 2 is illustrative only and that the heating element may be laid out in other patterns on the insulation material without departing from the scope of the invention. The respective ends of the heating element are connected to power source 18 at a terminal block 26. Importantly, heating unit 10 employs a temperature sensor 28 the output of which is a temperature signal St supplied to controller 16. Unlike previous heating units employing a temperature responsive switch which acts to cutoff power to a heating element if the temperature of the heating unit becomes too great, temperature sensor 28 only provides a sensed temperature input to controller 16 via a cable 30. Controller 16 is responsive to signal St so that if the temperature of heating unit 10 starts to increase above a selected heating value, controller 16 responds by changing the mark-space ratio of a control signal Si supplied to power source 18. This control signal controls the amount of time within a time interval that current is supplied to heating element 20. Thus, rather than shutting off the heating unit, the amount of heat produced during any given interval is alterable by changing the amount of time current is supplied to heating element 20 during that interval. If current is supplied a lesser amount of time during an interval than previously, the amount of heat produced by heating unit 10 is effectively lowered, as is the temperature to which a utensil placed upon the unit is heated. Besides helping prolong the useful life of heating element 20, this feature further is important in helping prevent the scorching of food.

Figure 11:
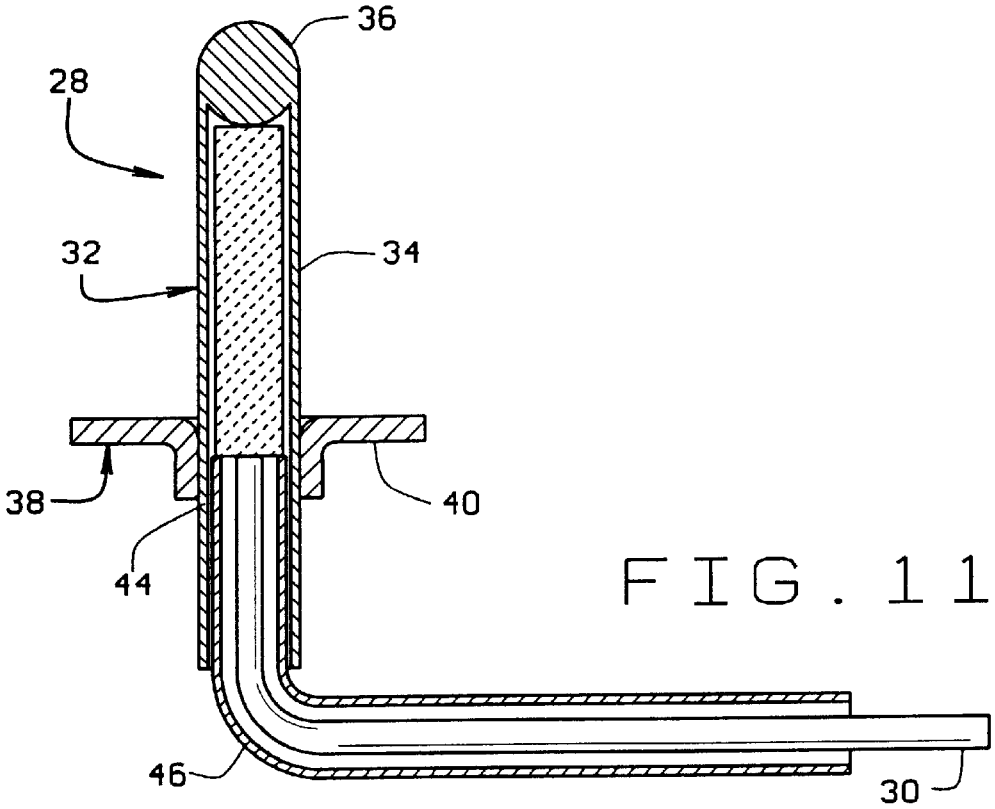
FIG. 11 is a sectional view of the thermal sensor used with the heating unit; and, FIG. 12 is a perspective view of the thermal sensor assembly.
Figure 12:
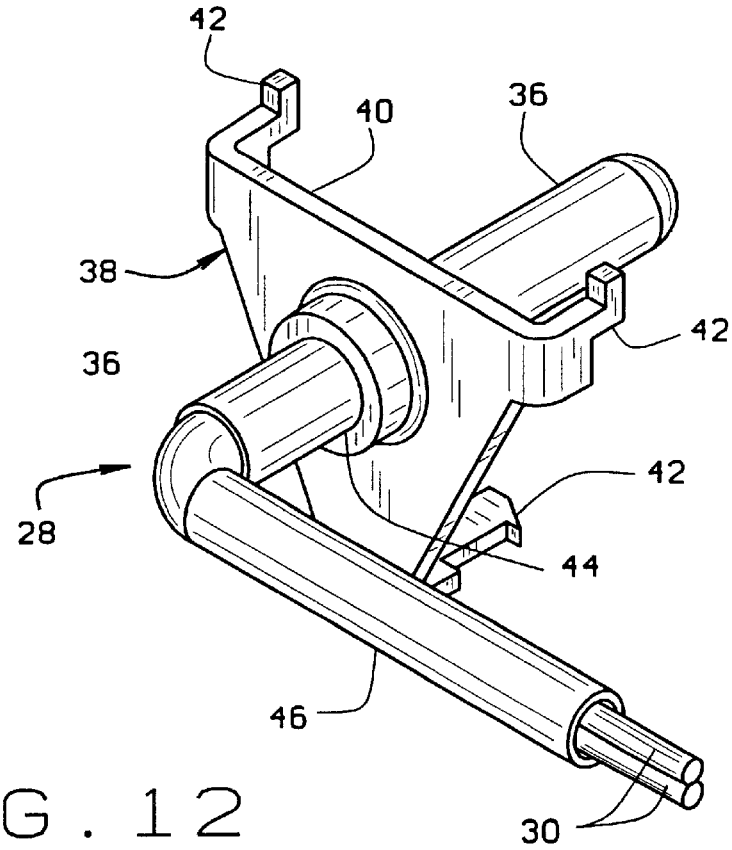

Referring to FIG. 11, thermal sensor 28 is shown to include a sensing element 32 which is, for example, a PRT type sensing element inserted in a ceramic jacket 34. In addition to a PRT sensor, other sensors which can be used for this sensing application include a resistance temperature detector (RTD) or T, E, J, K, or S type thermocouples. The sensing element is fitted in a stainless steel tube 36 which is rounded at one end and open at the other. A bracket 38 includes a triangular shaped plate 40 with depending legs 42 extending from each corner of the plate. Plate 40 has a central opening 44 sized for tube 36 to fit into the opening. A flexible fiber glass sleeve 46 is sized to fit into the open end of tube 36 with the inner end of the sleeve abutting one end of jacket 34. Electrical leads 30 from the temperature sensor run through the sleeve to controller 16. In FIGS. 2–4, a first installation of thermal sensor 28 in the heating unit assembly is shown. Bracket 38 is attached to bottom 50 of pan 22, there being a hole formed in the bottom of the pan through which tube 36 extends up into the pan. The temperature sensor is installed prior to installation of the heating element and insulation cake. Further, while shown in FIGS. 2–4 as being installed in the center of the pan, the temperature sensor can also be installed off-center without effecting its performance. The cake 24 of insulation material has a hole 52 extending therethrough and sized to receive tube 36. The rounded outer end of the tube extends through the upper end of this hole so sensing element 32 is appropriately positioned in the pan.

Figure 9:
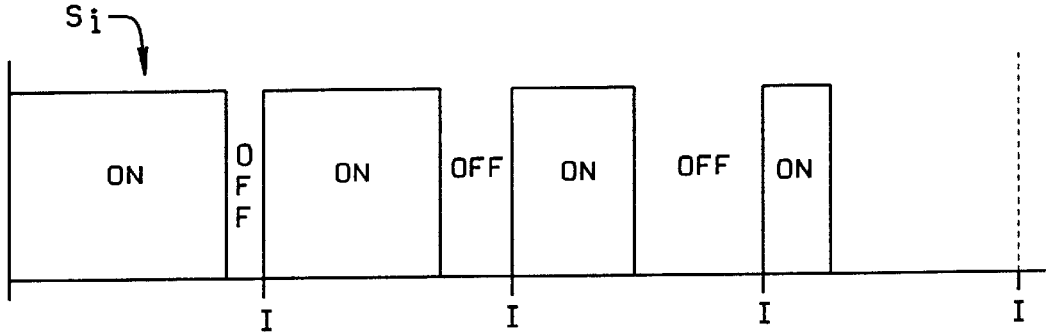
FIG. 9 illustrates a mark-space signal supplied to the heating unit to control its temperature.
Figure 10:
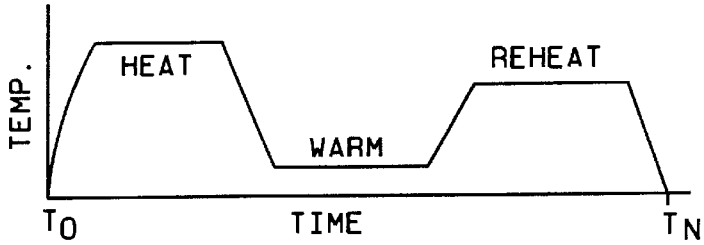
FIG. 10 is a time temperature profile illustrating how food is cooked with the heating unit.

As noted, controller 16 is responsive to inputs from thermal sensor 28 to control application of power to heating element 20. As shown in FIG. 9, controller 16 supplies a mark-space pulse input control signal Si to power source 18. The mark/space ratio of the signal is controllable over a wide range of on/off ratios as shown in FIG. 9. At any one time, the ratio determines the amount of time within a time interval I that source 18 supplies current to heating unit 10. The greater the amount of on-time to off-time within the interval, the longer power is supplied to the heating unit during that interval, and the higher the amount of heat produced by the heating unit during that interval.

Figure 5:
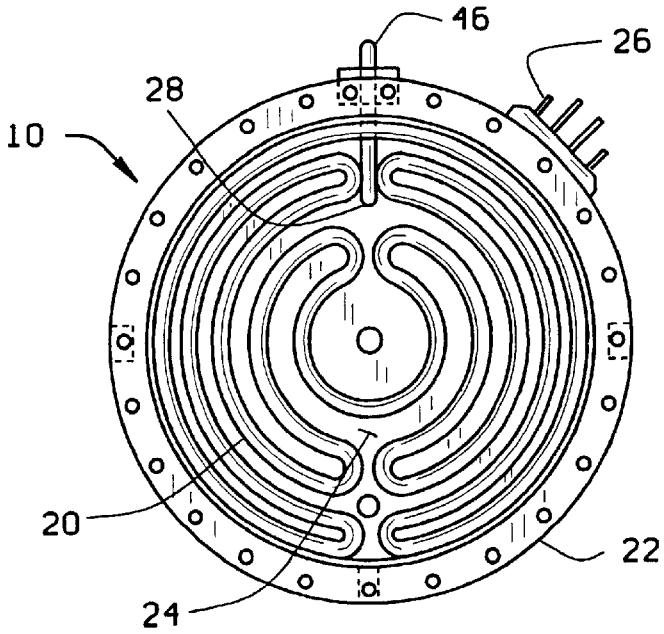
FIG. 5 is a top plan view of a second embodiment of the heating unit.
Figure 6:
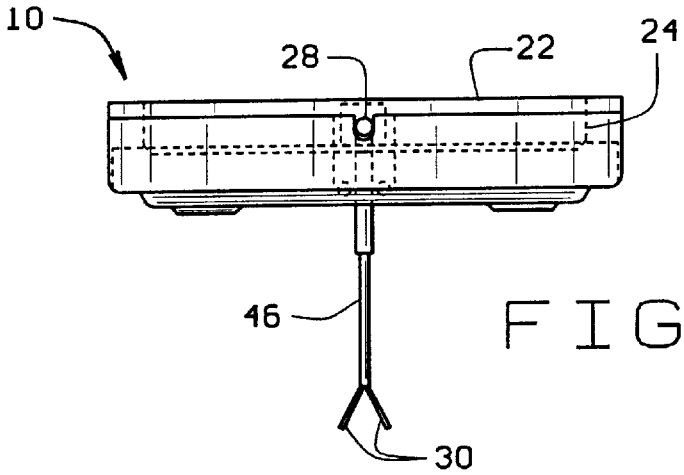
FIGS. 6 and 7 are respective side elevational views of the embodiment.
Figure 7:
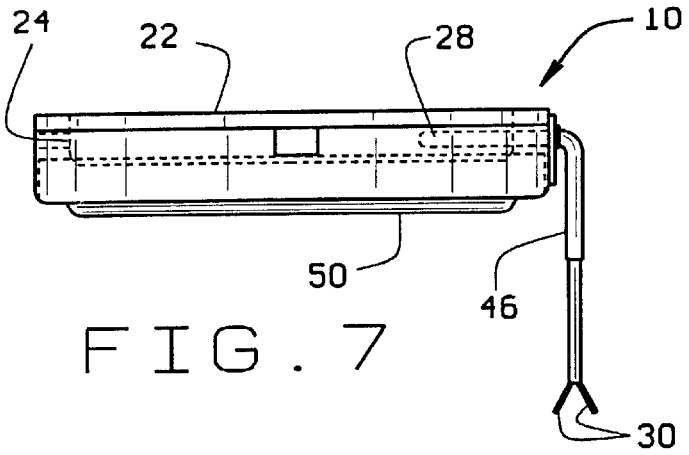

In FIGS. 5–7, an alternate embodiment of the heating unit is shown. Construction of this heating unit is the same as that of the heating unit 10 shown in FIGS. 2–4, except that now, a thermal sensor 28', rather than being mounted though the bottom of pan 22 is now installed through the side of the pan. An opening is formed in the side of pan 22 at a level above the upper surface of the cake 24 of insulation. Bracket 38 is secured to the sidewall of pan 22 so tube 36 will extend into the heating unit. The tube is not typically long enough to extend the thermal sensor into the center of the pan (although it could be), but it does project sufficiently far into the pan that the thermal sensor is placed where it accurately measures the heating unit temperature. Importantly, thermal sensor 28' extends across pan 22 so as to be perpendicular to heating element 20. In addition, the thermal sensor extends parallel to the plane of the cooking element. This geometry further helps insure that thermal sensor 28' accurately senses the temperature of the heating unit.

What has been described is an improved radiant electric heating unit for use in cook tops. The thermal switch normally used in such units is eliminated and replaced by a less expensive thermal sensing element which is a reliable element that supplies a temperature indication of the heating unit temperature to a controller controlling the supply of power to the heating unit. In one embodiment the thermal sensing element is located in the middle of the heat unit to sense heating unit temperature; while in a second embodiment, the thermal sensing element extends inwardly into the heating unit from the side of the unit. The improved heating unit is used in an advanced cooking system in which the heating unit temperature is precisely controlled throughout a cooking cycle for better food preparation.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A heating unit adapted to be installed in a cooktop wherein operation of the heating unit is controlled by a controller, said heating unit comprising:

a heating element to which an electric current is applied to generate heat, said heating element being disposed beneath a glass cooking surface;

a pan mounted beneath the cooking surface, the pan and the cooking surface defining a cavity, and an insulating member fitting in said pan and supporting said heating element in said pan; and a thermal sensor for sensing a temperature in the proximity of the heating element and supplying an indication of said temperature to said controller, said controller being responsive to said temperature indication from said thermal sensor to modulate the amount of power supplied to said heating element during a given interval to maintain said temperature in the cavity substantially at a preselected temperature;

wherein said thermal sensor is disposed in a spaced-apart relationship with an underside of said cooking surface, wherein said pan has an opening in a surface thereof and said thermal sensor is inserted through said opening and terminating at a point within said pan, said thermal sensor being positioned in a temperature sensing relationship to said heating element.

2. The heating unit of claim 1 wherein said heating element is a composition heating element.

3. The heating unit of claim 1 wherein said opening is in a bottom surface of said pan for said thermal sensor to be inserted in said heating unit through the bottom of the pan.

4. The heating unit of claim 1 wherein said pan has an opening in a sidewall thereof and said thermal sensor extends through said opening into said pan.

5. The heating unit of claim 4, wherein said insulating member comprises a cake of material fitted in said pan and said opening in said sidewall is positioned above an upper surface of said insulating member.

6. The heating unit of claim 5 wherein said thermal sensor extends above said heating element parallel to the plan of said heating element.

7. The heating unit of claim 1 wherein said heating element is a coil heating element.

8. The heating unit of claim 1 wherein said heating element is a ribbon heating element.

9. The heating unit of claim 1 wherein said heating element is an etched heating element.

10. The heating unit of claim 1 wherein said heating element is a cut foil heating element.

11. The heating unit of claim 10 wherein said heating element is a laser cut heating element.

12. The heating unit of claim 1 wherein said thermal sensor includes a PRT sensing element.

13. The heating unit of claim 1 wherein said thermal sensor is a RTD sensing element.

14. The heating unit of claim 1 wherein said thermal sensor is a thermocouple.

15. A heating unit adapted to be installed in a cooktop wherein operation of the heating unit is controlled by a controller, said heating unit comprising:

a heating element to which an electric current is applied to generate heat, said heating element being disposed beneath a glass cooking surface;

a pan mounted beneath the cooking surface, and an insulating member fitting in said pan and supporting said heating element in said pan, said pan and said insulating member forming a cavity beneath the cooking surface; and a thermal sensor for sensing a temperature in the cavity of the heating unit and supplying an indication of said temperature to said controller, said controller being responsive to said temperature indication from said thermal sensor to modulate the amount of power supplied to said heating element during a given interval to maintain said temperature in the cavity substantially at a preselected temperature;

wherein said thermal sensor is disposed in a spaced-apart relationship with an underside of said cooking surface, wherein said pan has an opening in a surface thereof and said thermal sensor is inserted through said opening and terminating at a point within the cavity, said thermal sensor being positioned in a temperature sensing relationship to said cavity.

16. The heating unit of claim 15 wherein said heating element is a composition heating element.

17. The heating unit of claim 15 wherein said thermal sensor includes a PRT sensing element.

18. The heating unit of claim 15 wherein said thermal sensor is a RID sensing element.

19. The heating unit of claim 15 wherein said thermal sensor is a thermocouple.

* * * * *

UNITED STATES PATENT AND TRADEMARK OFFICE

CERTIFICATE OF CORRECTION

PATENT NO. : 6,555,793 B2 
DATED : April 29, 2003
INVENTOR(S) : Simon P. Griffiths and Herbert G. Ray It is certified that error appears in the above-identified patent and that said Letters Patent is hereby corrected as shown below:

Column 5,
Line 44, delete "plan" and insert -- plane --

Signed and Sealed this

Fourteenth Day of October, 2003

JAMES E. ROGAN
*Director of the United States Patent and Trademark Office*